US009511928B2

(12) United States Patent
Black et al.

(10) Patent No.: US 9,511,928 B2
(45) Date of Patent: Dec. 6, 2016

(54) COLOR DISPENSING SYSTEM FOR RECREATIONAL GEAR

(71) Applicants: Clara Charlotte Black, Bellingham, WA (US); Noah Sebastian Black, Bellingham, WA (US); Amelia Gabrielle Black, Bellingham, WA (US)

(72) Inventors: Clara Charlotte Black, Bellingham, WA (US); Noah Sebastian Black, Bellingham, WA (US); Amelia Gabrielle Black, Bellingham, WA (US)

( * ) Notice: Subject to any disclaimer, the term of this patent is extended or adjusted under 35 U.S.C. 154(b) by 340 days.

(21) Appl. No.: 13/844,327

(22) Filed: Mar. 15, 2013

(65) Prior Publication Data

US 2014/0272122 A1 Sep. 18, 2014

(51) Int. Cl.

| | |
|---|---|
| ***B67D 7/84*** | (2010.01) |
| ***B65D 83/72*** | (2006.01) |
| ***B05B 12/00*** | (2006.01) |
| ***B05B 15/06*** | (2006.01) |
| ***B65D 83/20*** | (2006.01) |
| ***B65D 83/22*** | (2006.01) |
| ***B65D 83/38*** | (2006.01) |
| ***A43B 5/04*** | (2006.01) |
| ***A63C 19/06*** | (2006.01) |

(Continued)

(52) U.S. Cl.

CPC ..... *B65D 83/72* (2013.01); *A43B 5/0415* (2013.01); *A63C 19/065* (2013.01); *B05B 12/002* (2013.01); *B05B 15/061* (2013.01); *B65D 83/208* (2013.01); *B65D 83/22* (2013.01); *B65D 83/384* (2013.01); *A63C 5/06* (2013.01); *A63C 17/26* (2013.01); *A63C 19/10* (2013.01); *A63C 2019/067* (2013.01); *B05B 15/0437* (2013.01)

(58) Field of Classification Search

CPC ..... B65D 83/72; B65D 83/208; B65D 83/22; B65D 83/384; B65D 83/24; A43B 5/0415; A63C 19/065; A63C 2019/067; B05B 15/061; B05B 15/0437; B05B 12/002

USPC ..... 222/173, 175, 174, 153.11, 153.12; 427/136

See application file for complete search history.

(56) References Cited

U.S. PATENT DOCUMENTS 3,017,056 A * 1/1962 Bishop ..... B65D 83/203 222/164
3,144,174 A * 8/1964 Abplanalp ..... B65D 83/72 222/146.1

(Continued)

OTHER PUBLICATIONS

"Belt" Dictionary.com. http://www.dictionary.com/browse/belt, [retrieved Aug. 8, 2016].*

*Primary Examiner* — J. Casimer Jacyna
*Assistant Examiner* — Benjamin R Shaw
(74) *Attorney, Agent, or Firm* — Timothy Marc Shropshire; Garrett James O'Sullivan; MU Patents

(57) ABSTRACT

Spray color dispensing devices and associated systems and methods are disclosed. Color dispensing devices in accordance with certain embodiments include colorant contained in a pressure vessel, a pressure vessel holder including an attachment mechanism and an actuator system, and a control cable leading to a remote trigger controller. The remote trigger controller may be thumb operated or have a push button design, both of which may include a trigger locking device. There may be a deflector near the spray nozzle. The holder and actuator may allow only specifically designed pressure vessels. Also the pressure vessel may be insulated and/or heated to allow the color dispensing device to be used in cold environments.

19 Claims, 5 Drawing Sheets

(51) Int. Cl.

| | |
|---|---|
| *B05B 15/04* | (2006.01) |
| *A63C 5/06* | (2006.01) |
| *A63C 17/26* | (2006.01) |
| *A63C 19/10* | (2006.01) |

(56) References Cited

U.S. PATENT DOCUMENTS 3,229,859 A * 1/1966 Conroy ..... A47L 1/08 222/174
3,254,804 A * 6/1966 Grant ..... A47L 11/161 15/50.1
3,445,046 A * 5/1969 Wilson ..... B65D 83/384 222/175
3,446,402 A * 5/1969 Healy ..... B05B 1/30 219/214
3,485,206 A * 12/1969 Smrt ..... B65D 83/203 118/305
3,490,652 A * 1/1970 Thielen ..... B65D 83/16 222/174
3,549,054 A * 12/1970 Etter ..... B65D 83/206 222/180
3,856,209 A * 12/1974 Hickson ..... B65D 83/203 211/170
3,977,570 A * 8/1976 Smrt ..... B65D 83/203 222/174
4,023,711 A * 5/1977 Sena ..... B05B 15/064 222/174
5,518,148 A * 5/1996 Smrt ..... B05B 12/002 222/174
5,868,377 A * 2/1999 Taomo ..... A01D 34/90 123/398
6,062,443 A * 5/2000 Smrt ..... B05B 9/007 222/608
6,390,336 B1 * 5/2002 Orozco ..... B05B 9/0861 222/153.13
6,845,923 B1 * 1/2005 Slotsve ..... B05B 7/2478 222/174
6,851,582 B2 * 2/2005 Meyer ..... E04D 13/0762 222/174
7,076,916 B2 * 7/2006 Bianchini ..... A01M 1/2038 222/174
7,252,210 B1 * 8/2007 Schultz ..... B65D 83/203 222/174
7,717,300 B1 * 5/2010 Yarrusso, Jr. ..... A01M 1/2038 222/174
2006/0008317 A1 * 1/2006 Livingstone ..... A47G 27/0487 401/279
2006/0049214 A1 * 3/2006 Laveault ..... A01M 21/043 222/402.1
2007/0187431 A1 * 8/2007 Manker ..... B65D 50/06 222/153.11
2008/0173685 A1 * 7/2008 Welker ..... A01M 31/00 224/576
2009/0097901 A1 * 4/2009 McCarthy ..... B65D 83/208 401/138
2009/0217542 A1 * 9/2009 Watkins ..... A63C 19/06 33/775
2010/0006667 A1 * 1/2010 Nielsen ..... A63C 19/065 239/74
2010/0272885 A1 * 10/2010 Olsson ..... B65D 83/203 427/137
2011/0024460 A1 * 2/2011 Smrt ..... B65D 83/203 222/174
2011/0174903 A1 * 7/2011 Hogan ..... B05B 15/061 239/754
2011/0180626 A1 * 7/2011 Kang ..... A63C 19/065 239/225.1
2011/0284514 A1 * 11/2011 Koster ..... H02K 35/02 219/201
2012/0315823 A1 * 12/2012 Brzezinski ..... A63H 33/009 446/473

* cited by examiner

COLOR DISPENSING SYSTEM FOR RECREATIONAL GEAR

TECHNICAL FIELD

The present disclosure is directed generally to a spray color dispensing device that may be used for recreational, educational or professional purposes. More specifically it covers a pressurized spray can holding and dispensing device that can be controlled by use of a tethered control cable activated by a remote trigger. This device can be used in any situation where the user is moving with respect to the ground. The intension of this disclosure is to cover uses, methods and assemblies of this device.

BACKGROUND

A wide array of devices available for the purpose of striping sports fields, parking lots, and roadways is described in prior art. One embodiment of this device involves the use of an inverted spray can. Another embodiment of this device involves the use of a refillable pressure vessel. A body of prior art exists for both inverted spray cans and pressure vessels. The present device describes a new method and apparatus used to leave a colored trail as the user passes over the ground and adds details and features that are not incorporated in other devices or prior art.

This device can be used during all activities where this user is moving with reference to the ground. The purpose of leaving a trail may include enjoyment or satisfaction, marking a path, playing games such as follow the leader, leaving artistic patterns, creating challenging courses, to prove the user was there, educational reasons, demonstrations of technique, designating a trail, or for other reasons a mark may be desired. Fields of use for this device include, but are not limited to snow skiing, snowboarding, skate boarding, roller blading, roller skating, ice skating, scootering, running, jogging, hiking, bicycling snowmobiling, motorcycling, go-carting, and riding all terrain vehicles (ATVs).

DETAILED DESCRIPTION

The present disclosure is directed to a system and apparatus used to dispense a marking substance such that a trail is left behind a moving user. The following description identifies specific details with reference to FIGS. 1 through 5 to provide a thorough understanding of various embodiments of the disclosure. All the details that describe every aspect of the manufacture or use of this device are not described below to avoid unnecessarily obscuring the description of various embodiments of the disclosure. Moreover, although the following disclosure sets forth several embodiments of different aspects of the disclosure, other embodiments can have different configurations and/or different components than those described in this section. In addition, further embodiments of the disclosure may be practiced without several of the details described below, while still other embodiments of the disclosure may be practiced with additional details and/or features.

Figure 1B:
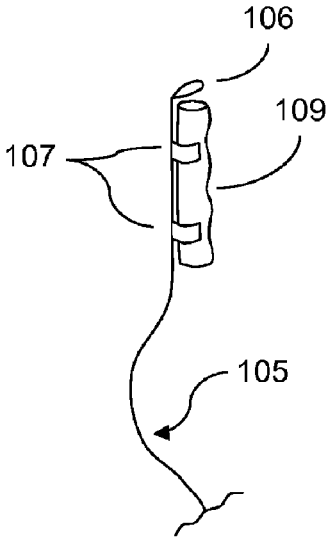
FIG. 1B is a side view of a second embodiment of the control trigger mounted to a handgrip.
Figure 1C:
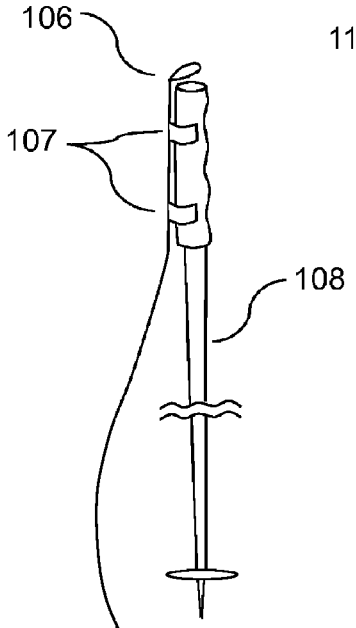
FIG. 1C is a front view of a third embodiment of the control trigger wherein the device is controlled by a push button.
Figure 1C:
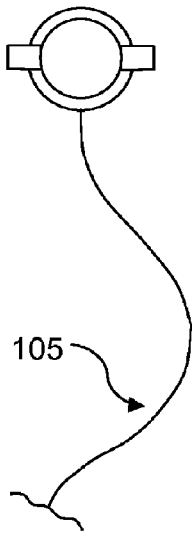
Figure 1A:
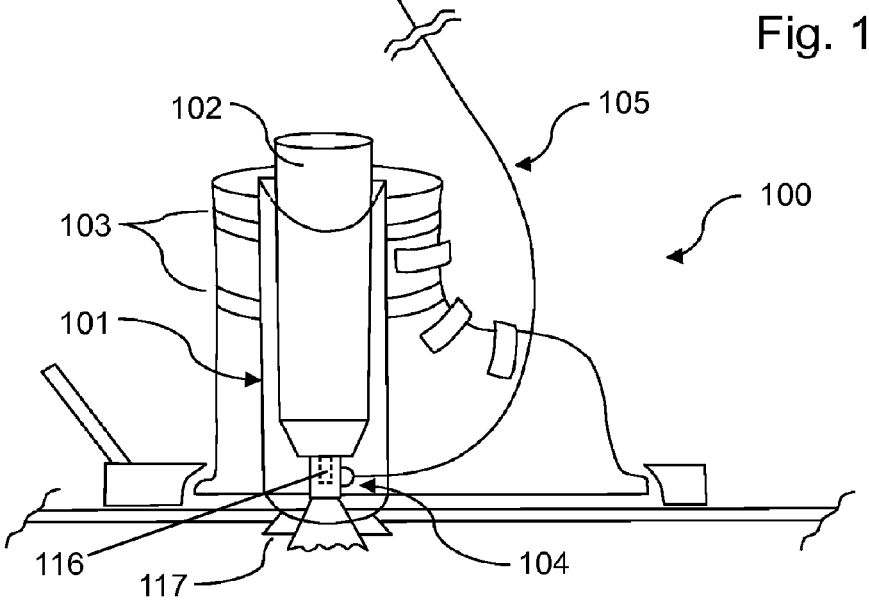
FIG. 1A is a side view showing the disclosed device attached to a snow ski boot in accordance with an embodiment of the disclosure.

The present disclosure is directed generally to a color dispensing system designed primarily for recreational use. FIG. 1A, for example, is a side view showing the mounting of the disclosed device on a snow ski boot in accordance with an embodiment of the disclosure. In other embodiments of this disclosure, and depending on the activity of the user, the holder may be attached to any part of the user and may be used for other activities. It may also be attached to an object being worn by, ridden by, or driven by a user.

In an embodiment of the present disclosure the user may fill a vessel with a colored material then increase the pressure in the vessel with a pump or by other means. The pressure vessel may or may not have an integral hand pump. A trigger and actuator mechanism as described within this disclosure would be used to discharge the material. In another embodiment of this disclosure the pressure vessel may be an inverted spray can. The term vessel shall be used throughout this disclosure to describe the color containing container. It is understood that 'color' means all colors including black and white.

Referring to FIG. 1A, the color dispensing system 100 includes a holder 101 for a pressurized spray vessel 102. The holder includes an attachment mechanism 103 for attaching the holder 101 to the user, and an actuator system 104 for controlling a valve 116 that when opened releases the contents contained within the prescribed vessel. A control cable 105 connects the actuator 104 to a trigger controller 106. For illustrative purposes FIG. 1A shows the cable 105 exiting the holder 101 near the bottom. In other embodiments the cable exits the holder near the top, thus allowing for better protection of the cable. Integral to the embodiment of the trigger controller 106 is a control trigger attachment mechanism 107 that allows the trigger controller 106 to be attached to various devices, including a ski pole 108 or a grip handle 109 as shown in FIG. 1B. Another embodiment of the control trigger is a control button 110 as shown in FIG. 1C. For all trigger controller embodiments, FIGS. 1A, 1B, and 1C, when the trigger is depressed, the control valve 116 is opened and the vessel contents 102 are released. An advantage of the present disclosure over prior art is the remotely activated trigger controller. Another advantage is the adaptability of the device to many different activities.

Figure 2:
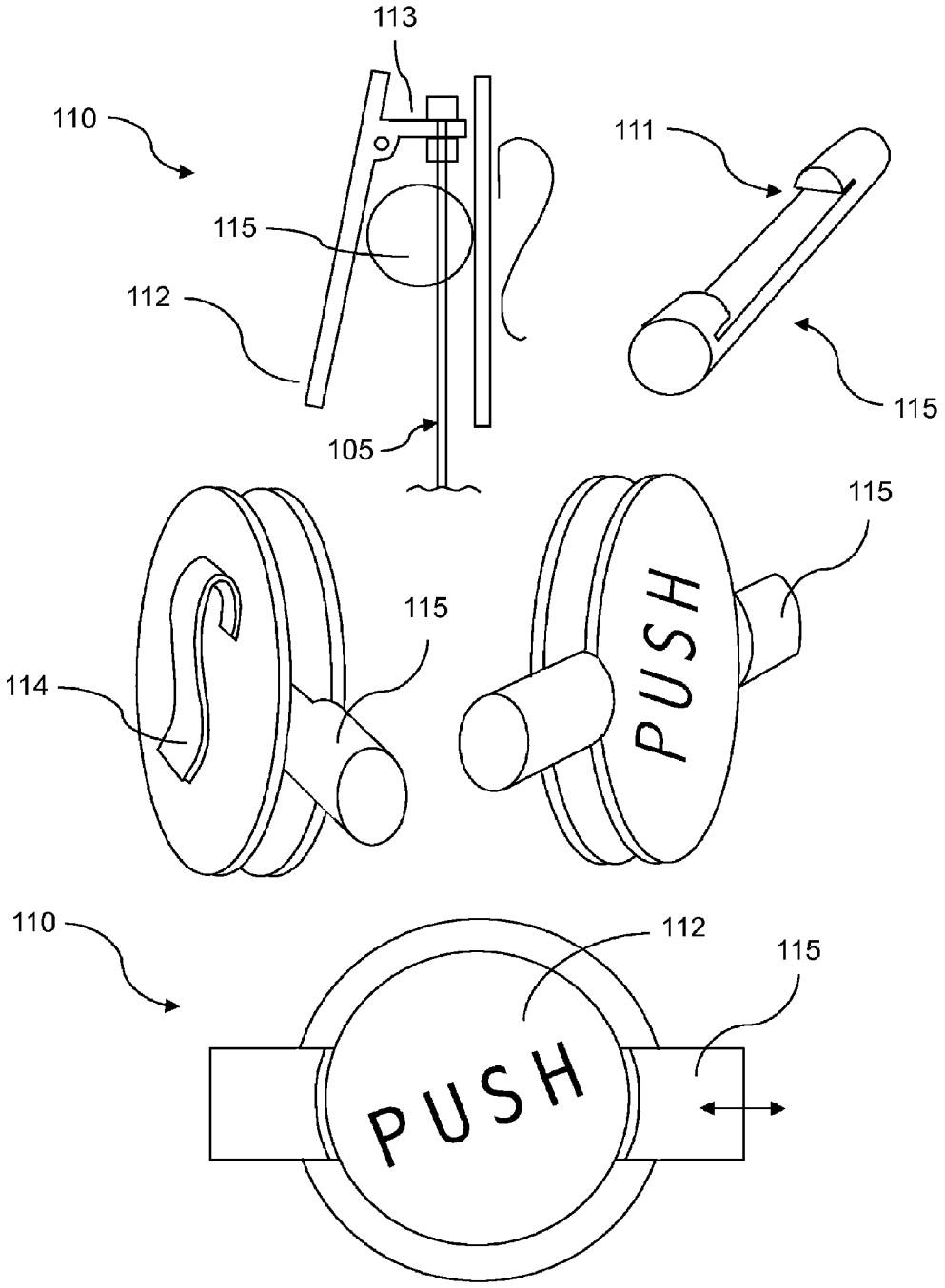
FIG. 2 shows front, side, and isometric views of the push button control trigger in accordance with an embodiment of the disclosure.

Shown in FIG. 2 are front, side, and isometric views of the push button control trigger in accordance with an embodiment of the disclosure. The push button trigger 110 is attached to the control cable 105 as shown in FIG. 1C. The other end of the control cable 105 is attached to the nozzle actuator 104 as shown in FIG. 1A. The push button trigger includes a push button 112, which is integral to a lever arm 113 that is attached to the control cable 105, a belt or pocket clip 114, and a locking mechanism, including a locking rod 115.

The locking feature may be used to lock the spray mechanism in the closed/off or open/on position. The locking rod 115 can be slid under the push button 112 from the left or the right. When the locking rod is centered the button 112 can be depressed and will release. If the locking rod 115 is moved to the left or right before the button 112 is depressed, the button 112 cannot be depressed and the pressure vessel valve 116 cannot be opened, thus the vessel contents cannot be released. If the locking rod 115 is slid to the left or right while the button 112 is depressed, the button 112 becomes locked down. This results in the vessel valve 116 being locked open resulting in a constant emptying of the vessel's contents. The button 112 remains locked down because the button 112 is held in place by the undercuts 111 in the locking rod 115. There are other embodiments to lock the control trigger. An advantage of this arrangement is that the locking mechanism and control is large and thus can be operated while the user is wearing insulated gloves. The trigger mechanism may be made of plastic, metal or other suitable materials.

Figure 3:
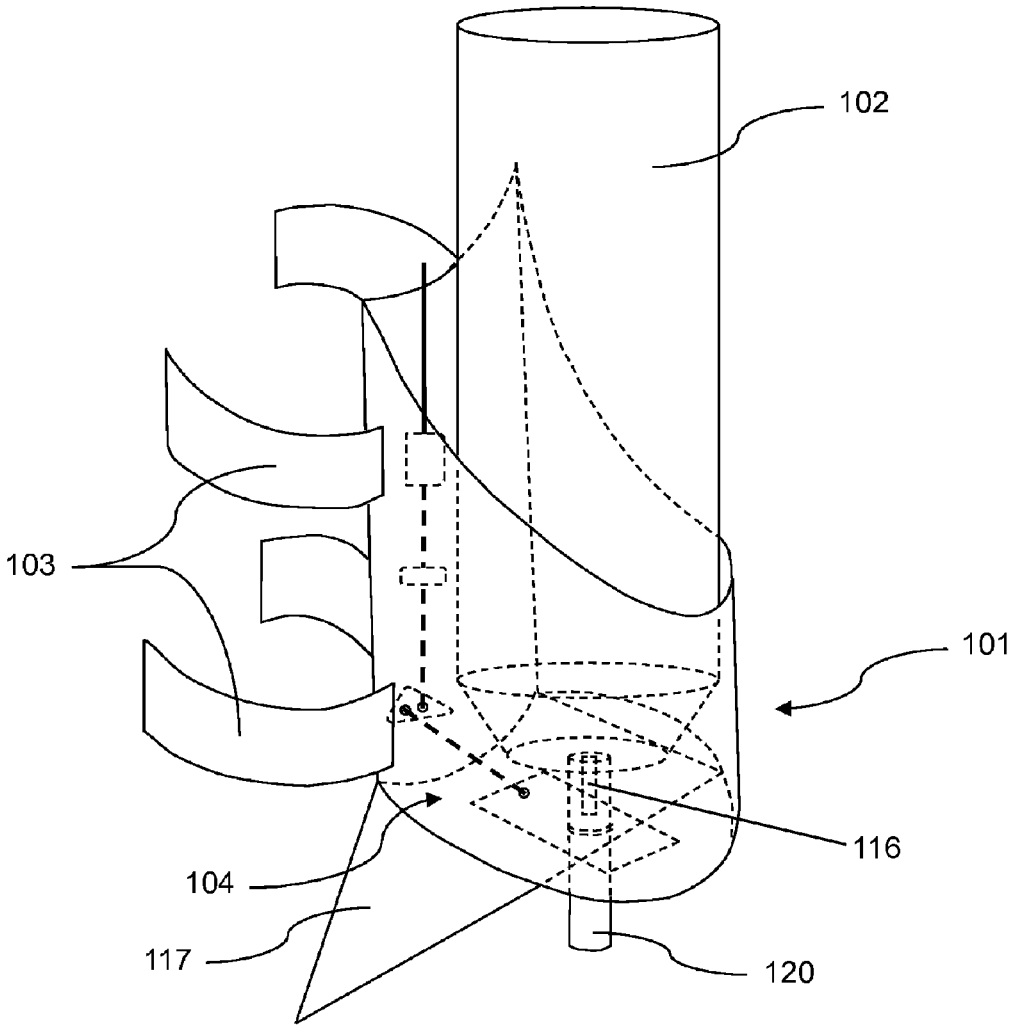
FIG. 3 is an isometric view of the portion of the device that acts to hold and activate an inverted spray can in accordance with an embodiment of the disclosure.

FIG. 3 shows the pressure vessel holder 101 portion of the device and several of its embodiments. The holder includes an area designed to hold a pressurized vessel 102, an attachment mechanism 103 for attaching the holder 101 to the user, an actuator system 104 used to open a valve 116, and a shield 117 to prevent overspray onto the object to which the holder is attached. The holder and mechanisms may be made of plastic, nylon, cloth, metal or other suitable materials. The shield 117 may or may not be made of a flexible material such that it will not cause damage if it strikes another object or the ground. One embodiment of the present disclosure is that the holder and actuator are oriented in such a way that upon activation, the nozzle is pushed away from the attachment mechanism. The advantage of this orientation is to minimize the amount of overspray on the deflector shield and the user.

Figure 4:
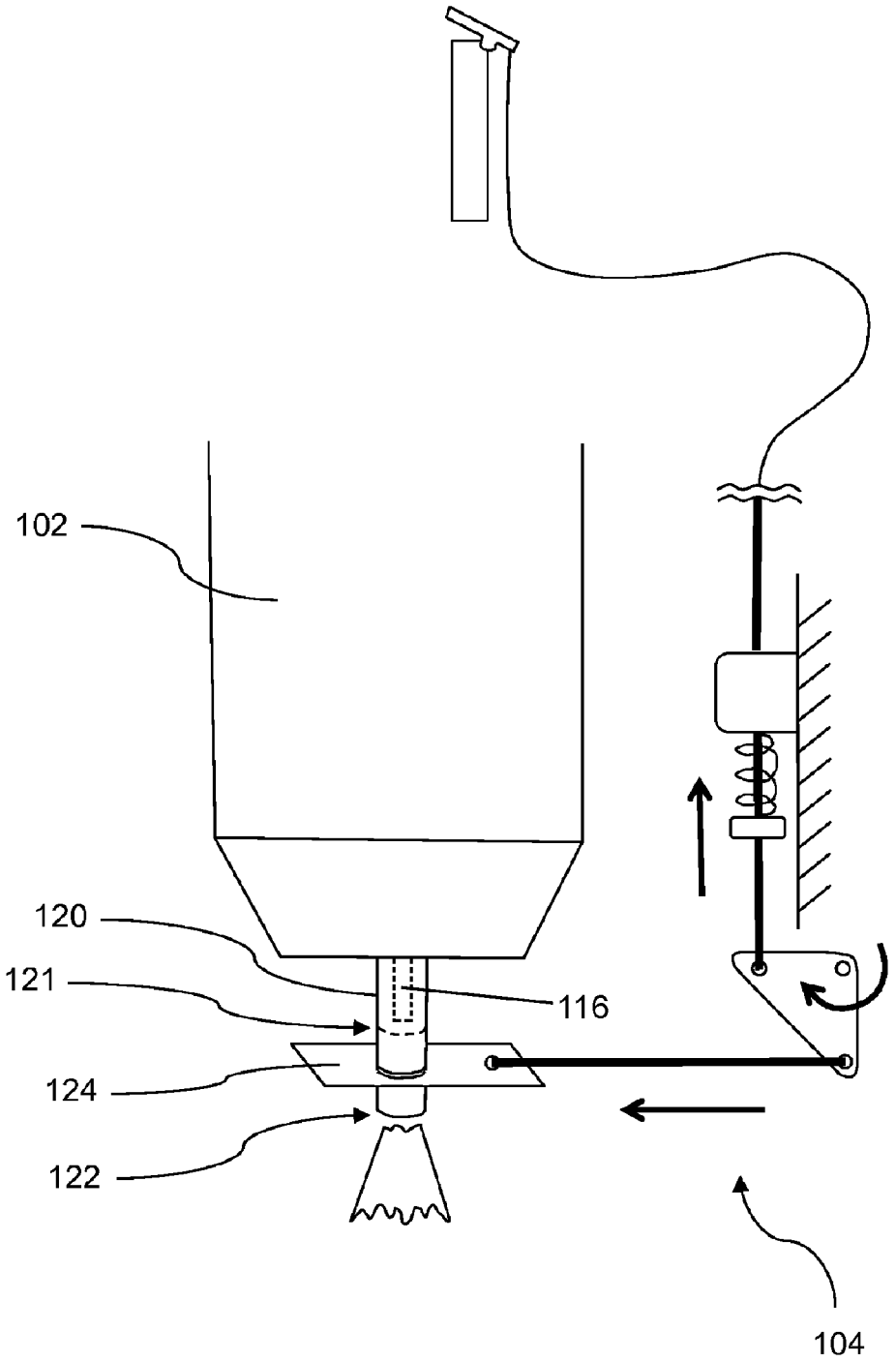
FIG. 4 is a front view showing the inverted spray can actuator in accordance with an embodiment of the disclosure.

FIG. 4 is a front view showing the actuating mechanism 104 in the embodiment where the pressure vessel 102 is an inverted spray can. An embodiment of the holder is the feature of being useable only with specifically designed inverted spray cans 102. This feature allows the manufacturer to control the contents of the spray can 102 in order to meet specific requirements. The desired traits of the contents may be, but are not limited to being safe, environmentally friendly, biodegradable, beneficial to the area being sprayed, offering specific elements of non-permanence, or having certain desired smells. An embodiment of this device is that the vessel may contain a marking substance that is not paint or chalk.

One embodiment for ensuring that specific contents are used with this device is to design the vessel 102 and the mating holder 101 to be of unique size or shape such that other vessels 102 will not fit into the holder 101. Another embodiment to accomplish this goal is to design the holder to use an inverted can 102 with an extended nozzle. As shown in FIG. 4, the holder can be designed such that a standard nozzle 120 of length 121 will not reach the actuator plate 124. A vessel design with an extended nozzle of length 122 would allow the nozzle 120 to reach the actuator plate 124 and would work with the holder 101. Another embodiment for this purpose is to design a nozzle 120 of specific cross-section and the corresponding mating cross-section in the actuator plate 124. For example, if the nozzle 120 cross-section was square, the mating hole in the nozzle receiver 124 must also be square to receive this particular nozzle 120.

Figure 5:
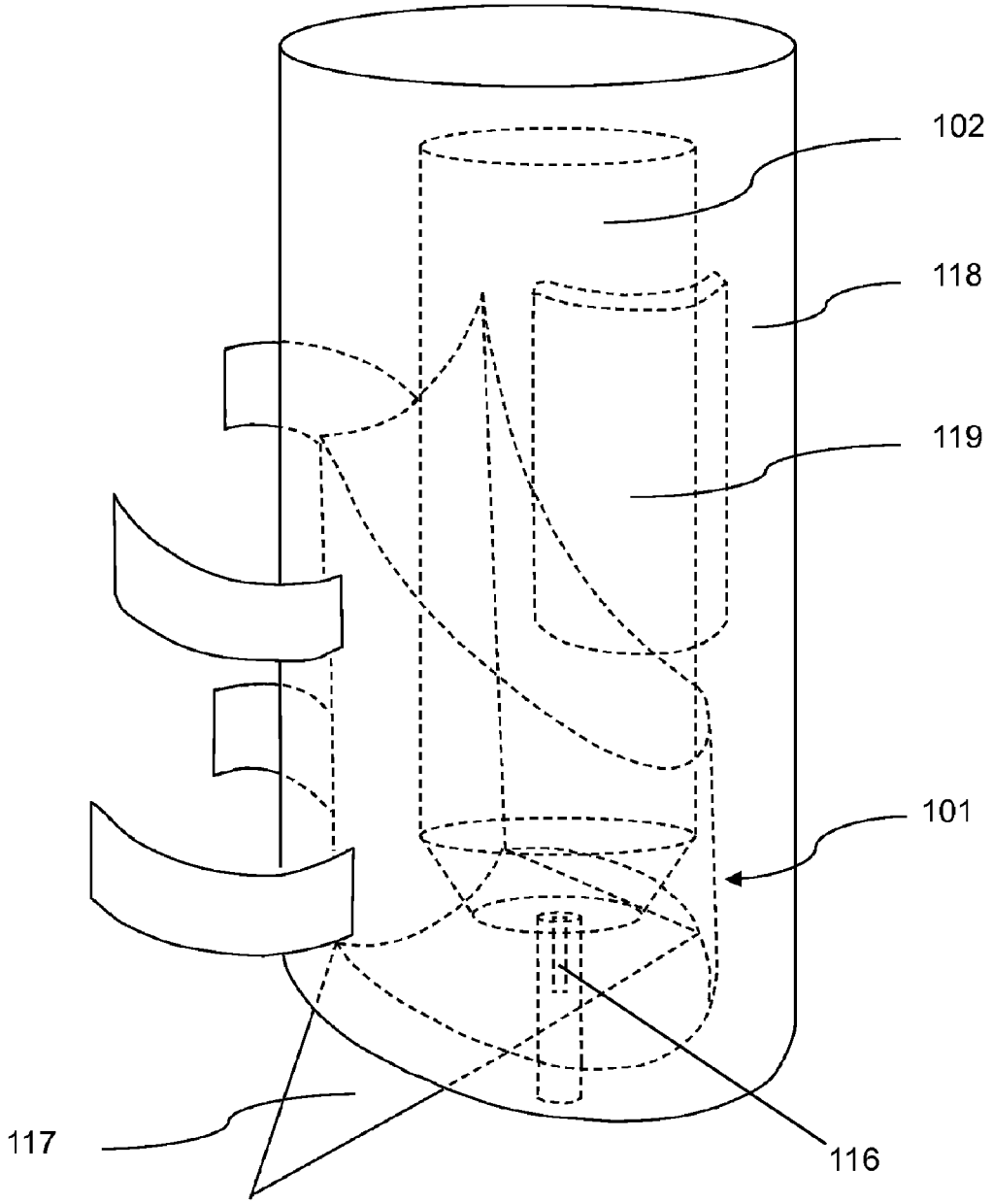
FIG. 5 is an isometric view showing the insulation and heating elements of the device surrounding the holder and inverted spray can in accordance with an embodiment of the disclosure.

Governed by the basic laws of thermodynamics, the pressure in a closed container is a function of its temperature. Since the device described herein may be operated in cold environments there may be conditions where it is advantageous to elevate the temperature of the vessel to maintain adequate pressure within the vessel. FIG. 5 shows an isometric view of an insulation wrap 118 and heating device 119 surrounding the vessel 102 and holder 101 in accordance with an embodiment of the disclosure. The warming device may be chemical reaction based or an electrically powered device. The insulation wrap may contain an integral pocket for the warming device. In other embodiments the heat from this device may be applied to the nozzle to prevent freezing at the tip. The insulation wrap may be made of fabric, fiberglass, plastic or other suitable materials.

From the foregoing, it will be appreciated that specific embodiments of the disclosure have been described herein for purposes of illustration, but that various modifications may be made without deviating from the scope of the disclosure. In addition, aspects described in the context of particular embodiments may be combined or eliminated in other embodiments. Further, although advantages associated with certain embodiments may also exhibit such advantages, and not all embodiments need necessarily exhibit such advantages to fall within the scope of the disclosure. Accordingly, the disclosure can include embodiments not expressly shown or described above.

We claim:

1. A color dispensing system comprising:

a. a pressurized spray vessel comprising:
   i. a valve; and
   ii. a nozzle for receiving the valve, the valve and the nozzle being axially aligned with a longitudinal axis of the spray vessel, wherein a substance is dispensed from the nozzle in alignment with said axis;

b. an actuator comprising a plate having an aperture extending there through, wherein the nozzle passes through the aperture;

c. a holder configured to receive the spray vessel;

d. a trigger controller comprising an attachment mechanism configured to releasably attach to a ski pole handle; and e. a control cable having a first end and a second end, wherein the first end connects to the trigger controller and the second end connects to the actuator, wherein depression of the trigger controller moves the actuator in a lateral direction relative to the longitudinal axis of the spray vessel from a first position to a second position to open the valve, and wherein release of the trigger controller relocates the actuator to the first position to close the valve, wherein the control cable permits omnidirectional movement of the holder relative to the trigger controller.

2. The system of claim 1, wherein the spray vessel is a spray can, wherein the spray vessel is inverted during use.

3. The system of claim 1, wherein the holder comprises an attachment mechanism that releasably attaches to a ski boot.

4. The system of claim 1, wherein the holder comprises an attachment mechanism that releasably attaches to an object worn by, ridden by, or driven by a user.

5. The system of claim 1, wherein the holder comprises a shield configured to block overspray from the spray vessel.

6. The system of claim 1, wherein the trigger controller further comprises a locking mechanism having at least a first position and a second position, wherein, when the locking mechanism is in the first position, the valve is locked in an open position, and wherein, when the locking mechanism is in the second position, the valve is locked in a closed position.

7. A color dispensing system comprising:

a. a pressurized spray vessel comprising:

i. a valve; and ii. a nozzle for receiving the valve, the valve and the nozzle being axially aligned with a longitudinal axis of the spray vessel, wherein a substance is dispensed from the nozzle in alignment with said axis;

b. an actuator comprising a plate having an aperture extending there through, wherein the nozzle passes through the aperture;

c. a holder configured to receive the spray vessel;

d. an insulation wrap configured to receive the holder and the spray vessel, wherein the nozzle protrudes through a bottom surface of the insulation wrap when the holder and the spray vessel are received by the insulation wrap;

e. a trigger controller; and f. a control cable having a first end and a second end, wherein the first end connects to the trigger controller and the second end connects to the actuator, wherein depression of the trigger controller moves the actuator in a lateral direction relative to the longitudinal axis of the spray vessel from a first position to a second position to open the valve, and wherein release of the trigger controller relocates the actuator to the first position to close the valve, wherein the control cable permits omnidirectional movement of the holder relative to the trigger controller.

8. The system of claim 7, further comprising a heating element in communication with the spray vessel.

9. The system of claim 8, wherein the insulation wrap comprises an integrated pocket for the heating element.

10. The system of claim 7, wherein the trigger controller comprises an attachment mechanism that releasably attaches to an object.

11. The system of claim 10, wherein the attachment mechanism comprises one or more clips.

12. The system of claim 10, wherein the object is a ski pole handle.

13. The system of claim 10, wherein the attachment mechanism is selected from the group consisting of a belt clip and a pocket clip.

14. The system of claim 7, wherein the trigger controller comprises a locking mechanism having at least a first position and a second position, wherein, when the locking mechanism is in the first position, the valve is locked in an open position, and wherein, when the locking mechanism is in the second position, the valve is locked in a closed position.

15. A color dispensing system comprising:

a. a pressurized spray vessel comprising:

i. a valve; and ii. a nozzle for receiving the valve, the valve and the nozzle being axially aligned with a longitudinal axis of the spray vessel, wherein a substance is dispensed from the nozzle in alignment with said axis when the valve is open, wherein the spray vessel is inverted during use;

b. an actuator comprising a plate having an aperture extending there through, wherein the nozzle passes through the aperture;

c. a holder configured to receive the spray vessel, the holder comprising:

i. an attachment mechanism that releasably attaches to an object worn by, ridden by, or driven by a user; and ii. a shield configured to block overspray from the spray vessel;

d. an insulation wrap, wherein the holder and the spray vessel are contained within the insulation wrap;

e. a heating device in communication with the spray vessel;

f. a trigger controller comprising:

i. an attachment mechanism that releasably attaches to an object; and ii. a locking mechanism having at least a first position and a second position, wherein, when the locking mechanism is in the first position, the valve is locked in an open position, and wherein, when the locking mechanism is in the second position, the valve is locked in a closed position; and g. a control cable having a first end and a second end, wherein the first end connects to the trigger controller and the second end connects to the actuator, wherein depression of the trigger controller moves the actuator in a lateral direction relative to the longitudinal axis of the spray vessel from a first position to a second position to open the valve, and wherein release of the trigger controller relocates the actuator to the first position to close the valve, wherein the control cable permits omnidirectional movement of the holder relative to the trigger controller.

16. The system of claim 15, wherein the insulation wrap comprises an integrated pocket for the heating device.

17. The system of claim 15, wherein the trigger controller attachment mechanism comprises one or more clips.

18. The system of claim 17, wherein the object to which the one or more clips of the trigger controller attaches is a ski pole handle.

19. The system of claim 15, wherein the trigger controller attachment mechanism is selected from the group consisting of a belt clip and a pocket clip.

* * * * *